United States Patent [19]

Read

[11] Patent Number: 4,530,392

[45] Date of Patent: Jul. 23, 1985

[54] CONTINUOUS CASTING MOLD

[75] Inventor: Robert D. Read, Beaumont, Tex.

[73] Assignee: North Star Steel Texas, Inc., Beaumont, Tex.

[21] Appl. No.: 496,750

[22] Filed: May 20, 1983

[51] Int. Cl.[3] ..... B22D 11/12

[52] U.S. Cl. ..... 164/268; 164/418; 164/342

[58] Field of Search ..... 164/418, 459, 121, 137, 164/342, 268

[56] References Cited

U.S. PATENT DOCUMENTS

| | | | |
|---|---|---|---|
| 4,026,346 | 5/1977 | Birat | 164/504 |
| 4,057,100 | 11/1977 | Lossack | 164/418 |
| 4,103,732 | 8/1978 | Habert | 164/418 |

*Primary Examiner*—Kuang Y. Lin
*Assistant Examiner*—G. M. Reid
*Attorney, Agent, or Firm*—Ralph H. Dougherty

[57] ABSTRACT

A continuous casting mold for the casting of molten metals such as steel has a stainless steel insert within the top flange which is resistant to adherence of molten metal splash and spatter, as well as resistant to gouging from cleaning by an oxygen lance. The insert has a lubrication capability, and is held in place within the top flange by a retaining plate.

6 Claims, 7 Drawing Figures

Fig. 3
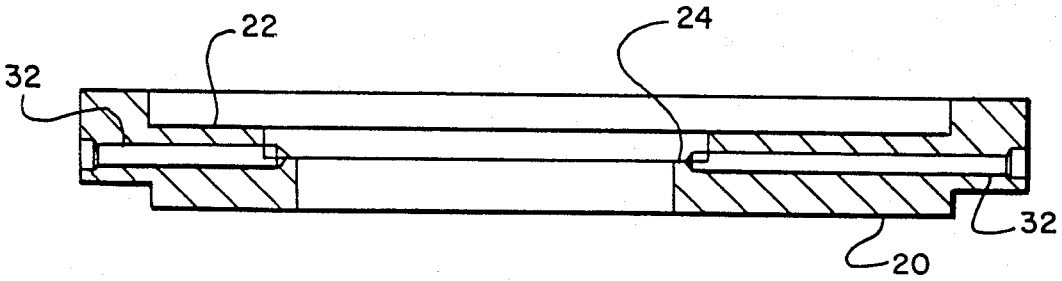
Fig. 7
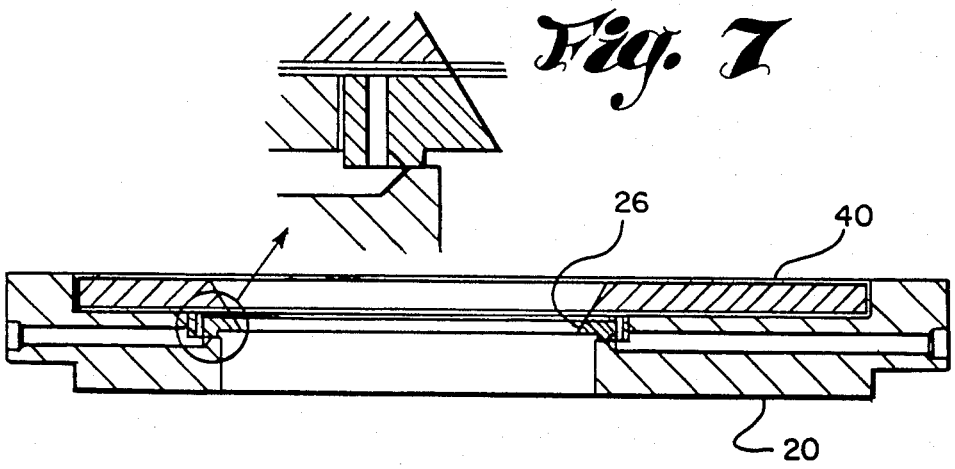
Fig. 6

CONTINUOUS CASTING MOLD

BACKGROUND OF THE INVENTION

This relates to the continuous casting of molten metals, and more particularly to the continuous casting of steel. In continuous casting, molten metal is generally poured from a ladle into an intermediate holding vessel known as a tundish. Both ladles and tundishes commonly have a nozzle in the bottom of the vessel through which the molten metal is poured. The receiving vessel is a water-cooled, open ended mold, which oscillates vertically during the pouring operation.

At the top of the mold, as presently configured, is a mold top flange, which is sometimes known as a top plate. This top flange is provided with a generally central opening through which molten metal is poured into the casting mold. During pouring, molten metal will splash onto the top flange where it solidifies, as the mold is cool in relation to the molten metal. A ragged pouring stream will also cause spatters of molten metal to adhere to the mold top flange. The solidified metal particles adhering to the mold top flange are known as "clingers". The opening at the top of the mold is reduced in area by the presence of clingers, which are removed by burning with an oxygen lance. The lance also damages the interior edges of the mold top flange, rendering it gouged and rough. The molten metal splash and spatter have an even greater tendency to adhere to the rough surfaces of the top flange than to the smooth surfaces of the top flange. The splash and spatter remain in place where they impact the top flange, rather than running down into the mold while still molten. Thus, the present solution to the problem of clingers on a continuous casting mold top flange of burning or melting them with an oxygen lance actually contributes to the problem.

After about 150 to 200 heats of steel have been cast through a mold top flange, the interior edges of the casting opening in the top flange becomes so rough that the top flange must be removed from service and rebuilt.

The currently practiced rebuilding procedure is to build up the surface of the top flange to beyond its original configuration by adding weld metal, then to machine the flange to its original dimensions. Large steel mills have a machine shop on the premises to handle this procedure, but most of the small mills and the newer mini-mills have the repair made by an independent-contractor, thereby incurring substantial costs, including shipping costs.

SUMMARY OF THE INVENTION

I have developed a mold for the continuous casting of metals such as steel, which will minimize the problem of clingers. A stainless steel insert within the top flange provides both the desired resistance to clingers and resistance to damage from an oxygen lance. Being much tougher than ordinary steel, the stainless steel insert resists gouging and roughening from the effects of burning or melting clingers with an oxygen lance.

OBJECTS OF THE INVENTION

It is the principal object of this invention to provide a mold apparatus for continuous casting of molten metals that is resistant to the adherence of clingers.

It is another object of this invention to provide a mold apparatus having a top flange that is resistant to gouging from oxygen lances.

It is also an object of this invention to provide a mold apparatus that has long top flange life.

It is also an object of this invention to provide a mold apparatus that will generate a substantial cost saving in its operation.

BRIEF DESCRIPTION OF THE DRAWINGS

FIG. 3 is a cross-sectional view of the top flange taken along line 6—6 of FIG. 2.

FIG. 6 is a cross-sectional view of the top flange similar to FIG. 3, but with the top flange insert and retaining plate in place.

FIG. 7 is an enlargement of the circumscribed portion of the top flange insert of FIG. 6, showing greater detail.

DETAILED DESCRIPTION

Figure 1:
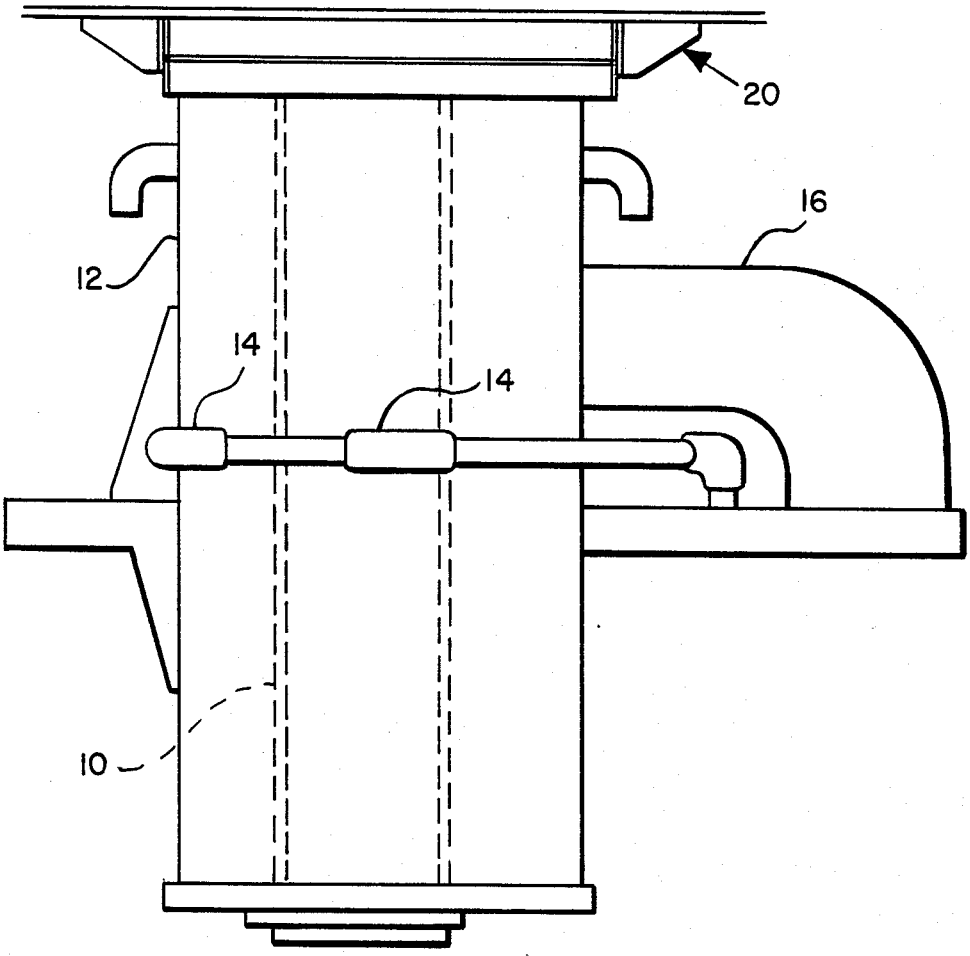
FIG. 1 is an elevational view of a continuous casting mold.
Figure 2:
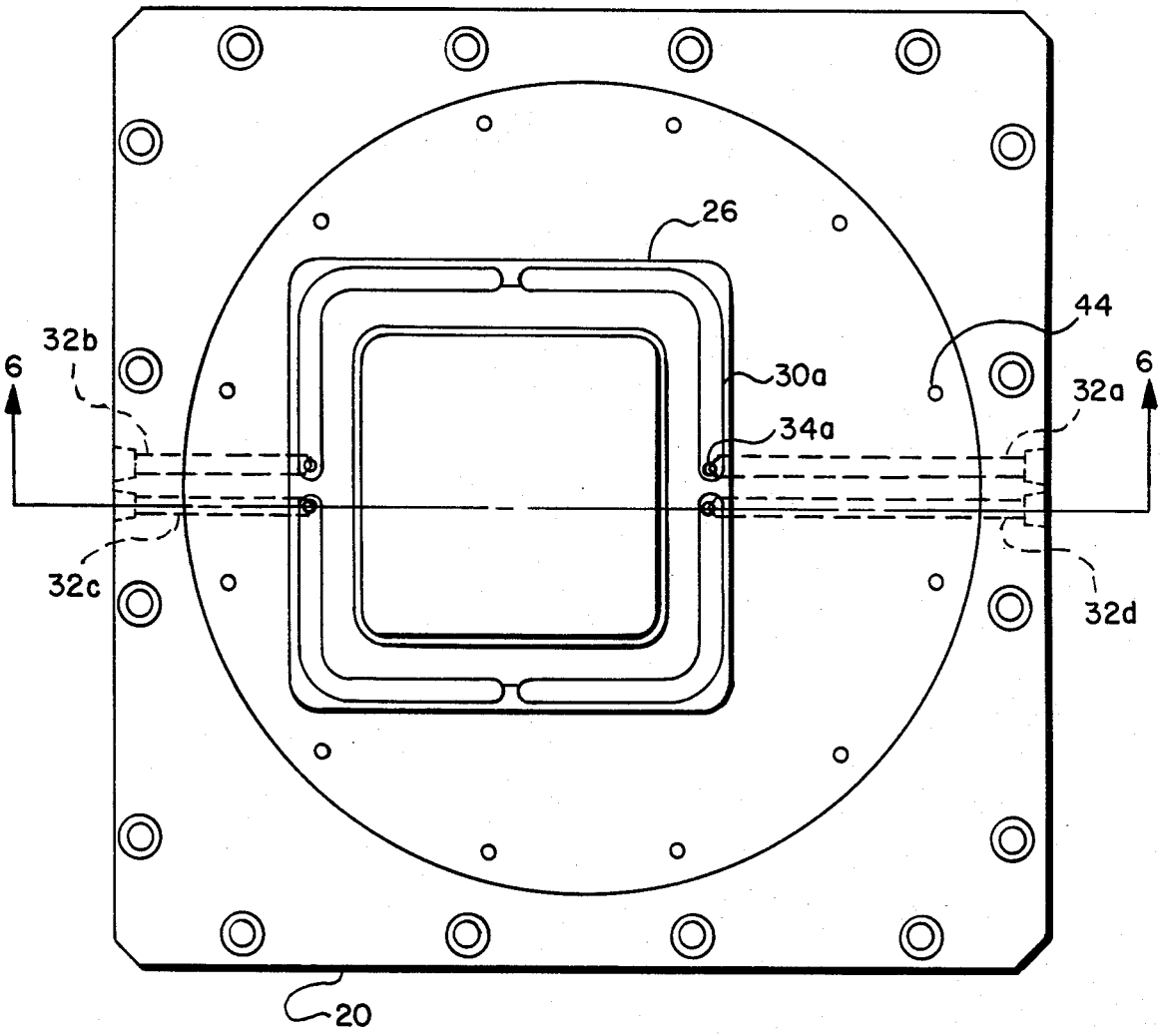
FIG. 2 is a top view of the continuous casting mold of the invention showing the top flange and top flange insert in place but with the retaining plate removed.

Referring now to the drawings, and more particularly to FIG. 1, a tubular continuous casting mold 10 is fixed within a hollow, water-cooled mold jacket 12. Although the mold is depicted as non-concentric with the mold jacket, this is merely a matter of choice. The jacket is provided with a multiple water inlet 14 and water outlet 16 to maintain a flow of cooling water through the mold jacket. This cools the mold and the molten metal therein to solidification temperature.

Figure 4:
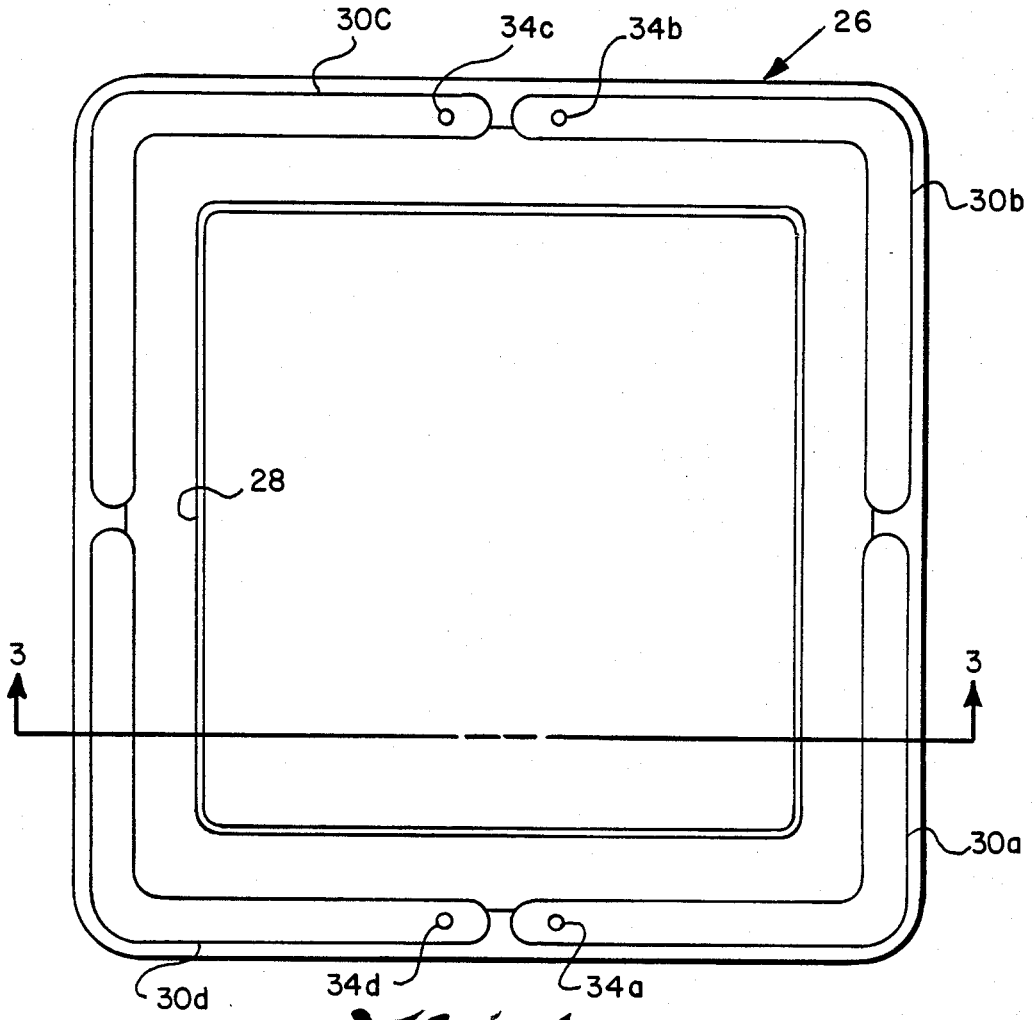
FIG. 4 is a plan view of the top flange insert.
Figure 5:
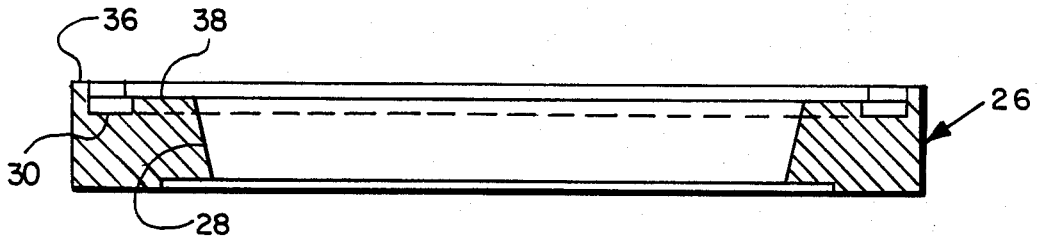
FIG. 5 is a cross-sectional view of the top flange insert taken along line 3—3 of FIG. 4.

A mold top flange or top plate 20 is fixed atop the mold and mold jacket. The top flange has an upper machined recess 22 for receiving a retaining plate therein, and a lower machined recess 24 within said upper machined recess 22 for receiving a flange insert 26 therein. The flange insert 26, as best seen in FIGS. 4 and 5, is provided with a central vertical opening 28, and a set of corner grooves 30*a*, 30*b*, 30*c*, and 30*d* in its upper surface. Central opening 28 preferably has tapered sides as shown in FIG. 5 to promote downward flow of the hot metal into the mold. Lubrication holes 32*a*, 32*b*, 32*c* and 32*d* extend horizontally through top flange 20, from the outer wall into the bottom of lower recess 24. Vertical lubrication holes 34*a*, 34*b*, 34*c*, 34*d* extend through flange insert 26 as shown, terminating in the respective corner grooves. The inner terminus of horizontal lubrication holes 32 in top flange 20 communicates with the bottom of vertical lubrication holes 34 in flange insert 26. The top surface 36 of flange insert 26 between the corner grooves 30 and the outer edge of the flange insert has a higher elevation than the top surface of inner lip 38 of flange 20 lying between the corner grooves and the inner edge of the flange insert, so that lubricant will flow over the inner lip of the flange insert onto all the mold sides. The difference in elevation between surface 36 and inner lip 38 can be from about 0.015 inches to about 0.065 inches, but I have found a difference of 0.020 inches to be adequate for good lubricant flow.

The flange insert 26 is held in place by retaining plate 40, which has a central hole 42 for the pouring of molten metal therethrough. Plate 40 is fixed to top flange 20 by bolts 44. Although retaining plate 40 is shown as round, it could be any other desired configuration.

Flange insert 26 is made from stainless steel, preferably from AISI grade 304 stainless steel. The surface of stainless steel is not adherent to clingers, and it is tough, resisting gouging, cutting, and scoring from direct contact with oxygen lances.

Test results using a continuous casting mold with a stainless steel insert 26 have resulted in an insert life of 900 heats, whereas previously, the top flange had to be removed, rebuilt and remachined about every 150 to 200 heats. The slightly increased cost of the top flange with insert has been recouped many times over by savings in extended life and reduction of repair and rebuilding time.

SUMMARY OF THE ACHIEVEMENTS OF THE OBJECTS OF THE INVENTION

It is readily apparent from the above that I have invented a mold for continuous casting that is resistant to clingers, that is resistant to gouging from oxygen lances, and that has both a longer useful life and lower maintenance cost than molds presently available.

Although only a preferred embodiment of this invention has been shown and described, it will be understood that changes and modifications can be made therein by one of skill in the art of continuous casting. It is therefore to be understood that this invention is not to be limited by the foregoing specification, but only by the scope of the appended claims.

What is claimed is:

1. In a tubular continuous casting mold having a top flange at the top thereof, the top flange being provided with a generally central opening for the pouring of molten metal therethrough into the continuous casting mold, the improvement comprising:

(a) an upper recess in the top of said top flange surrounding said generally central opening, and adapted to receive a retaining plate therein;

(b) a second lower recess surrounding said generally central opening, said second recess having lesser horizontal dimensions than those of said upper recess, said second recess being adapted to receive a flange insert therein;

(c) a stainless steel flange insert removably positioned in said lower recess, said flange insert having a generally central vertical opening for the pouring of molten metal therethrough; and (d) a retaining plate removably fastened into said upper recess, said retaining plate having a generally central vertical opening aligned with each other pouring opening, and having its upper surface substantially co-planar with the top of said top flange.

2. A mold according to claim 1, further comprising:

(a) an annular lubricant groove in the top face of said flange insert;

(b) an inner lip of lower elevation than the upper surface of said flange insert; and (c) means for injecting lubricant into said lubricant groove.

3. A mold according to claim 2 wherein said flange insert is provided with at least one vertical lubricant port terminating in said lubricant groove.

4. A mold according to claim 3 wherein said top flange is provided with at least one lubricant hole extending generally horizontally and communicating with said lubricant port in said flange insert.

5. A mold according to claim 1 wherein said flange insert is 304 stainless steel.

6. A mold according to claim 4 wherein said annular lubricant groove has a plurality of stops forming a plurality of grooves, the total of which plurality of grooves form an annular configuration in the upper face of said flange insert, each of said plurality of grooves is provided with a vertical lubricant port, and said top flange is provided with a lubricant hole communicating with each lubricant port.

* * * * *